US006461236B2

(12) United States Patent
Richardson

(10) Patent No.: US 6,461,236 B2
(45) Date of Patent: Oct. 8, 2002

(54) ROOF VENTS

(75) Inventor: Christopher Richardson, Clitheroe (GB)

(73) Assignee: Ultraframe (UK) Limited, Clitheroe (GB)

( * ) Notice: Subject to any disclaimer, the term of this patent is extended or adjusted under 35 U.S.C. 154(b) by 0 days.

(21) Appl. No.: 09/794,520

(22) Filed: Feb. 27, 2001

(65) Prior Publication Data

US 2001/0039179 A1 Nov. 8, 2001

(30) Foreign Application Priority Data

Feb. 28, 2000 (GB) ..... 0004597

(51) Int. Cl.[7] ..... F24F 7/00
(52) U.S. Cl. ..... 454/358; 454/364
(58) Field of Search ..... 454/365, 366, 454/364, 358

(56) References Cited

U.S. PATENT DOCUMENTS

| | | | | | |
|---|---|---|---|---|---|
| 4,057,941 | A | | 11/1977 | Schwartz | |
| 4,069,627 | A | | 1/1978 | Pegg | |
| 4,756,127 | A | * | 7/1988 | Helterbrand et al. | 52/90 |
| 4,936,110 | A | * | 6/1990 | Kuckens | 62/260 |
| 6,112,493 | A | * | 9/2000 | Rickman | 52/640 |
| 6,161,346 | A | * | 12/2000 | Richardson | 52/198 |

* cited by examiner

*Primary Examiner*—Harold Joyce
*Assistant Examiner*—Derek S. Boles
(74) *Attorney, Agent, or Firm*—Wood, Phillips, Katz, Clark & Mortimer

(57) ABSTRACT

A roof vent suitable for a conservatory roof of the type comprising glazing bars supporting glazing panels therebetween, the roof vent comprises a surround mountable between a pair of glazing bars and a cover for the surround and hingedly connected thereto.

1 Claim, 7 Drawing Sheets

ROOF VENTS

An object of this invention is to provide an improved roof vent suitable for inclusion in a conservatory roof.

According to this invention there is provided a roof vent suitable for a conservatory roof of the type comprising glazing bars supporting glazing panels therebetween, the roof vent comprising a surround mountable between a pair of glazing bars and a cover for the surround and hingedly connected thereto.

The surround is preferably mounted between the glazing bars in a similar fashion to the glazing panels. In other words it is preferable for the surround to have sides capable of coupling to the glazing bars using one or more coupling formations of the glazing bars. In a preferred embodiment, the surround and glazing bars have mutually engageable channel slots on their sides, preferably so that the surround can be slid into place between the glazing bars.

The roof vent of the invention preferably includes a spacer box at its rear so that the roof vent is spaced from a wall or other supporting structure for the roof. The spacer box preferably has perforations, ideally in end panels, to allow heat to dissipate.

Other preferred features and advantages of the roof vent of the invention will now be further described, by way of example only, with reference to the accompanying drawings, in which.

Figure 1:
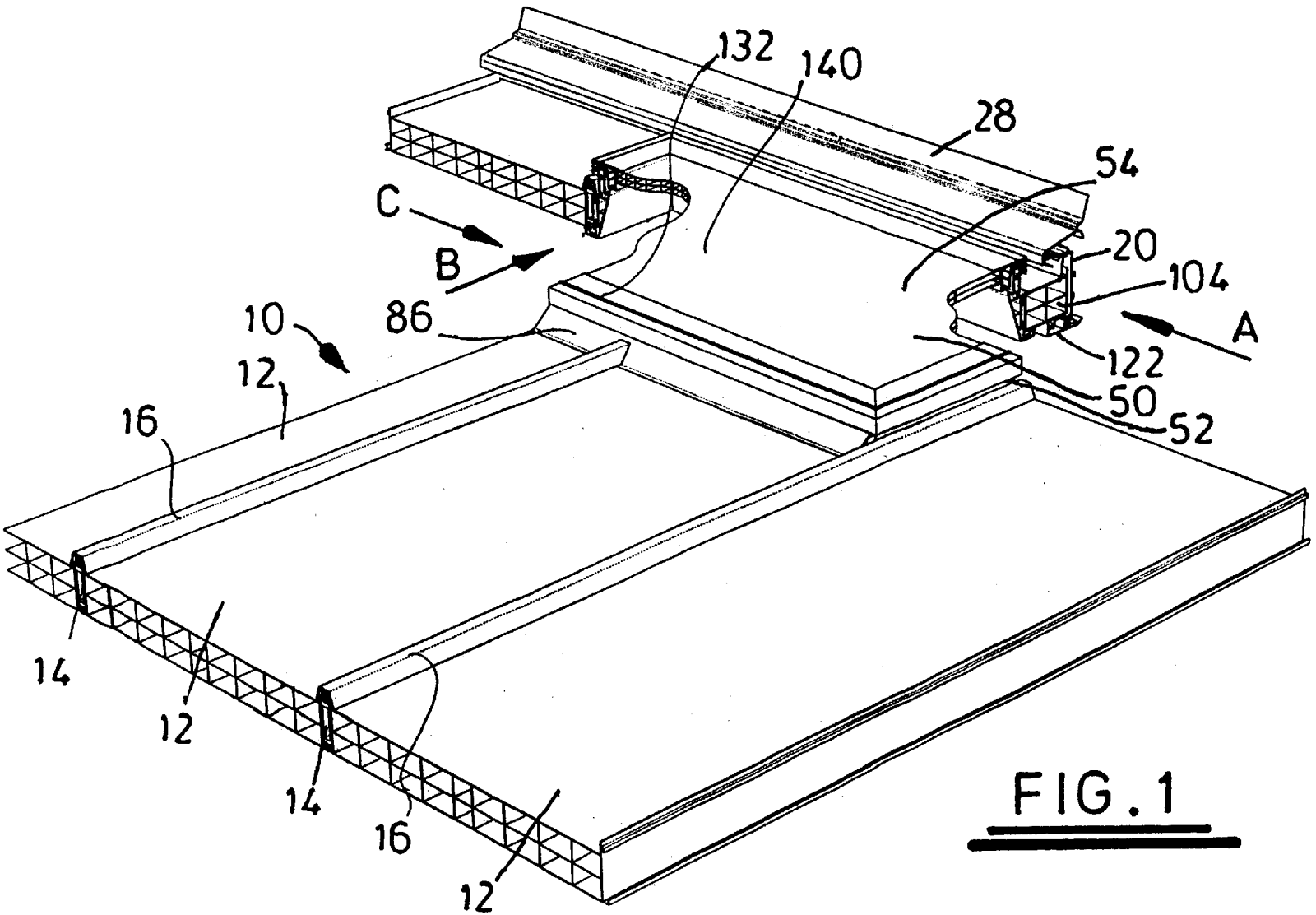
FIG. 1 shows a conservatory roof with a roof vent of the invention partially cut away.
Figure 2:
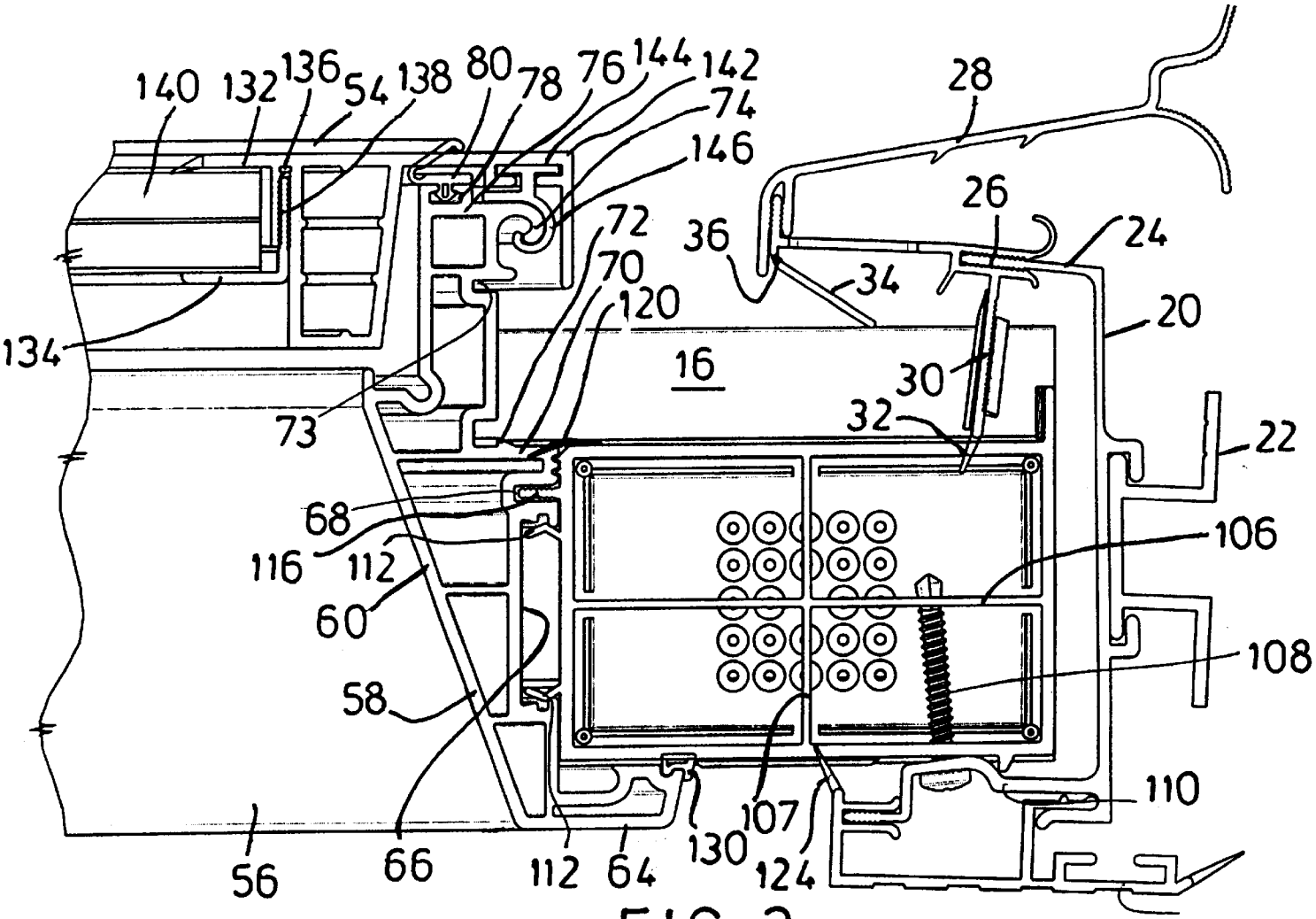
FIG. 2 is a view in the direction of arrow A of FIG. 1.
Figure 3:
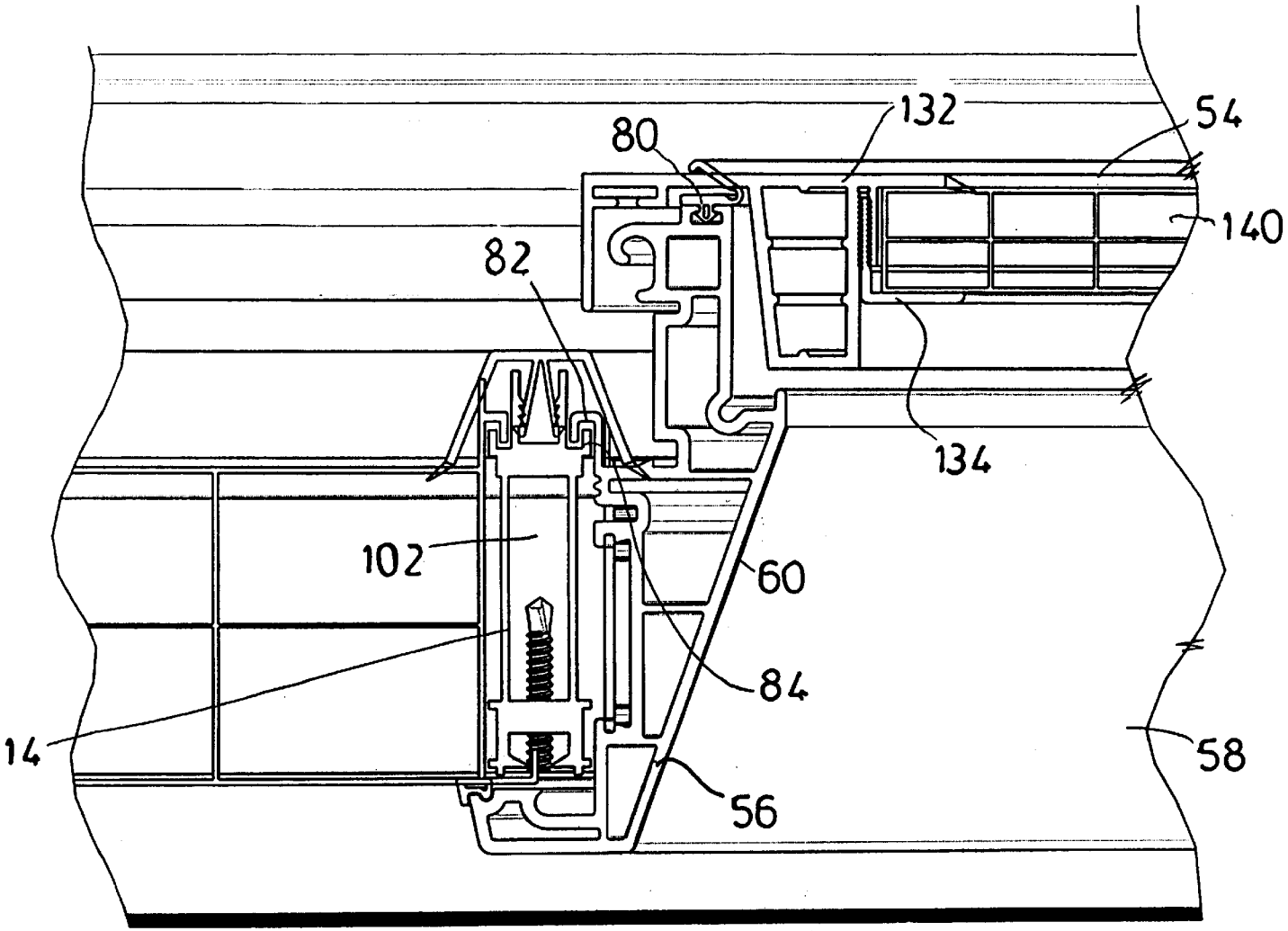
FIG. 3 is a view in the direction of arrow B of FIG. 1.
Figure 4:
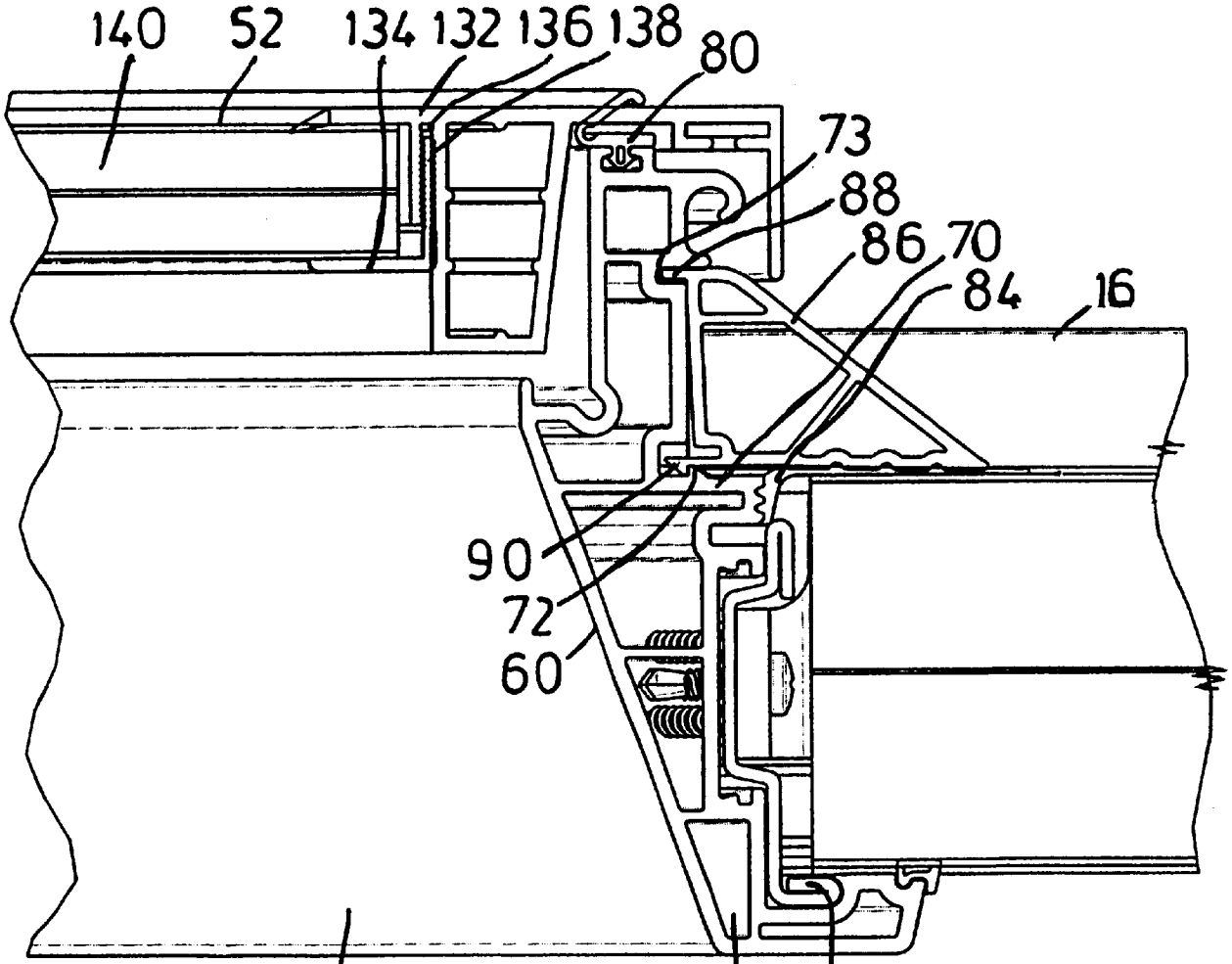
FIG. 4 is a view in the direction of arrow C of FIG. 1.
Figure 5:
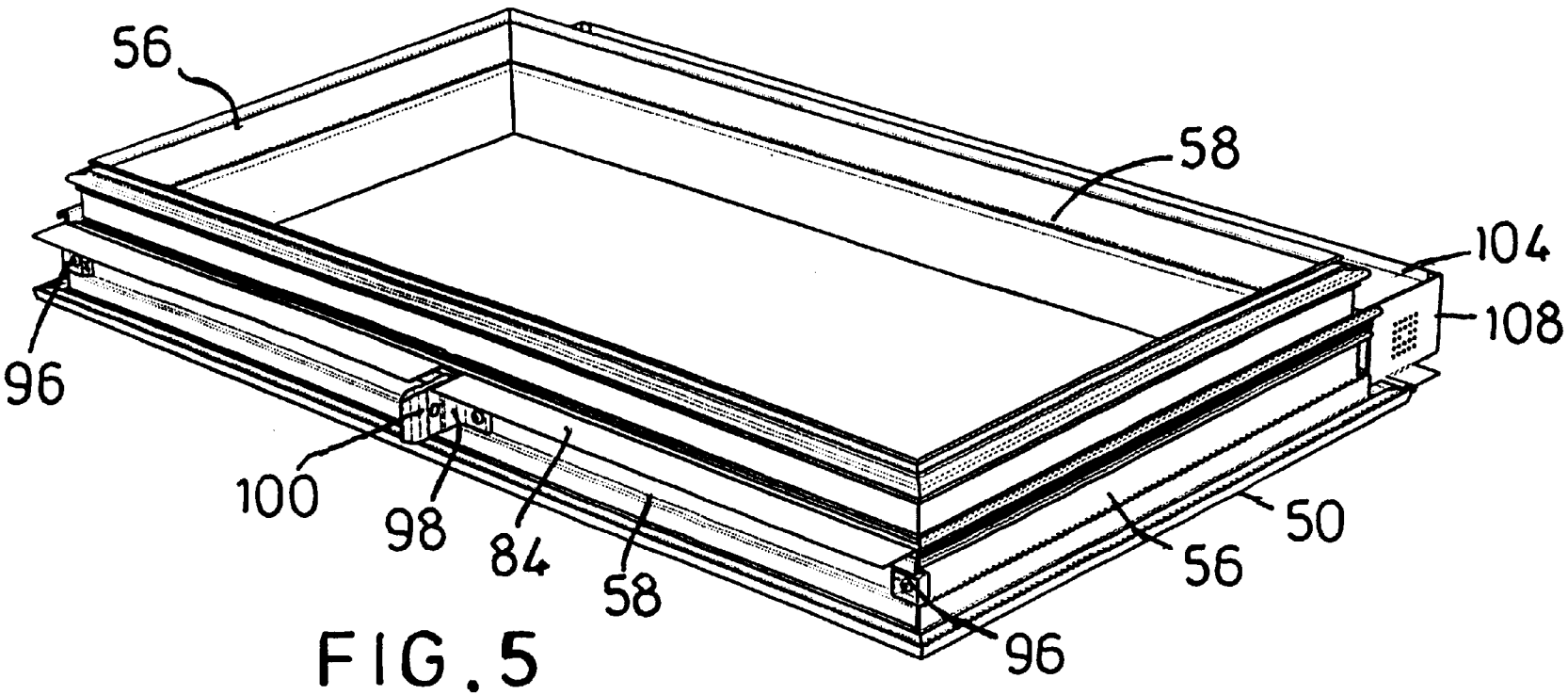
FIG. 5 is a perspective view from one corner of a roof vent surround.
Figure 6:
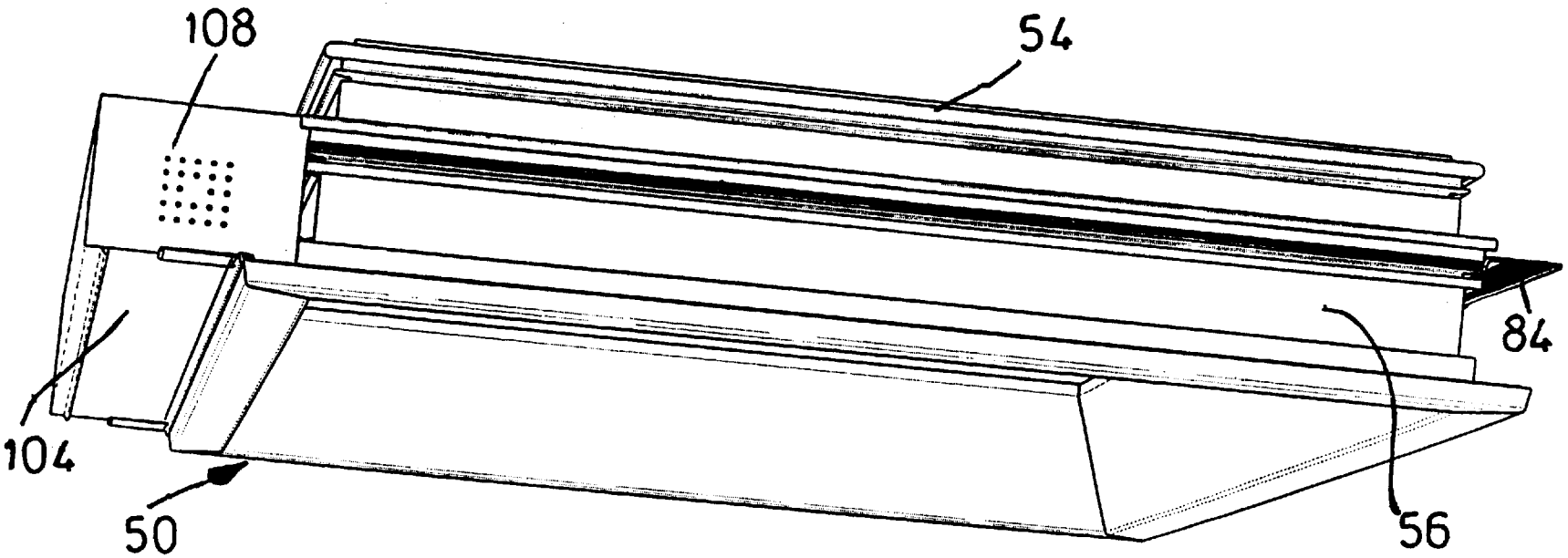
FIG. 6 is a side view of the roof vent surround of FIG. 5.

Referring to the accompanying drawings, a conservatory roof 10 supported at its upper side from a wall or other suitable structure comprises glazing panels 12, typically of PVC or polycarbonate, supported between glazing bars 14 and held down by cappings 16 retained by the glazing bars. Only the upper end of the roof is shown and the upper ends of the glazing bars and panels are supported in channel member 20 slidably mounted on spaced brackets 22 screwed to the wall. The channel member 20 has a top side 24 ending in a barb 26 onto which is push fitted a top cover 28 that includes a depending web 30 with gasket material 32 on its end to seal against the glazing panels 12 and near its forward end a rain baffle 34 that has a flexible hinge 36 to urge it downwards onto the top glazing bars cappings 16.

The roof includes a vent 50 comprising a surround 52 and a cover 54 hingedly mounted on one side of the surround. The surround is constructed from four sections of a u-PVC extrusion mitred and heat welded together to form a rectangle. The surround sides 56 are slightly different from its ends 58 as will be described later. The surround has a lower part with sloping internal faces 60. The surround has an upper part and shaped outer faces to provide locations for attachment thereto of other components of the roof vent system and for attachment of the surround to the existing roof structure.

The outside of the surround has from the bottom upward a flange 64 above which is a recess 66 then a slot 68 before it is stepped inwards forming a ledge 70 with a rib 72 thereon. A further slot 73 is spaced above the ledge 70. From the ledge, the surround extends upwards to a curved hinge part 74. The surround then has a top surface 76 with a slot 78 for receiving a gasket strip 80.

The sides 56 of the surround 52 have extending upwards from the end of the ledge .an inverted channel section flange 82, which is a sliding fit into a side channel 84 of the glazing bar 14 to which normally a glazing panel couples. That enables the surround 52 to be sufficiently wide to occupy the width of one or even two glazing panels because it can be slid into position between glazing bars.

The surround 52 has on its front a sealing flap 84, that overlies the glazing panel or panels 12 abutting the surround. A triangular section trim 86 is pushed into the front of the surround and has top and bottom extensions 88, 90 that locate in the slot 73 and over the rib 72 respectively to hold the sealing flap 84 down on the glazing panels.

The vent surround 52 does not occupy the whole length of the roof and so provision has to be made for connection of a shorter glazing bar 14 length to the front of the surround when the vent is of double panel width. A shaped steel reinforcing strip 92 locates in the channel 66 to give the front of the surround strength and is held in place by screws 96 at opposite ends and by, a central bracket 98 having a spigot 100 that locates in the duct 102 of the glazing bar, where it is bolted in place.

Figure 8:
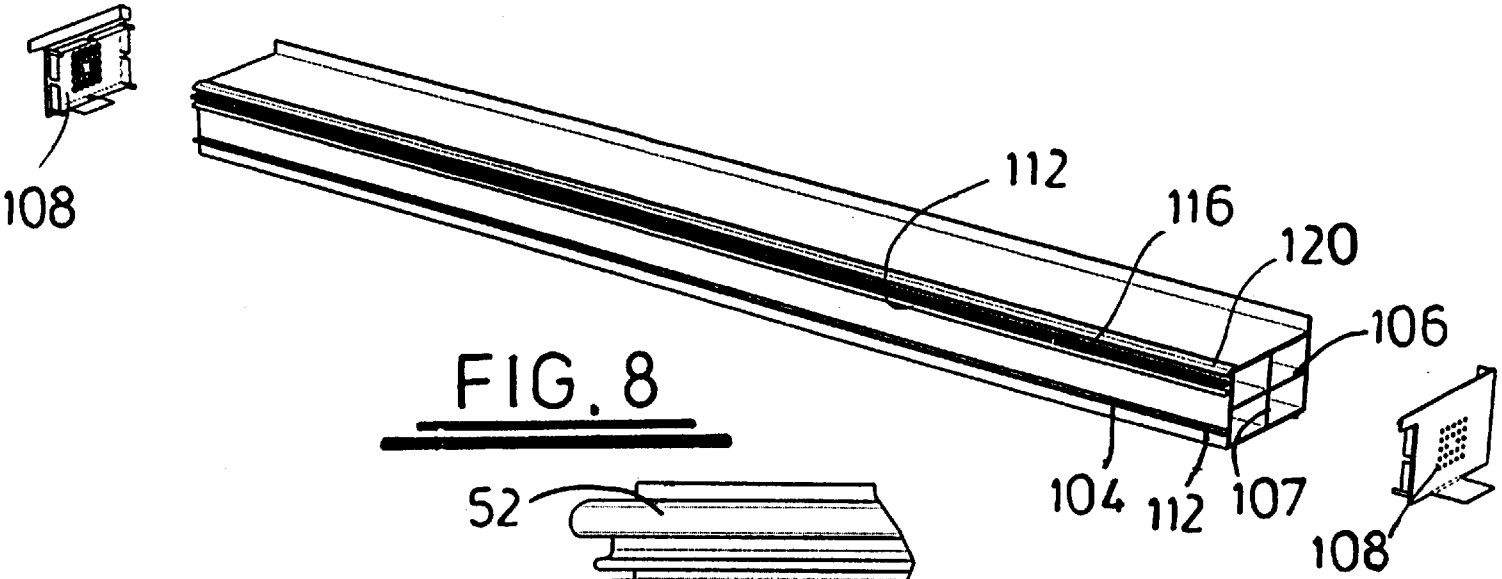
FIG. 8 is an exploded view of a spacer component for the roof vent surround.
Figure 7:
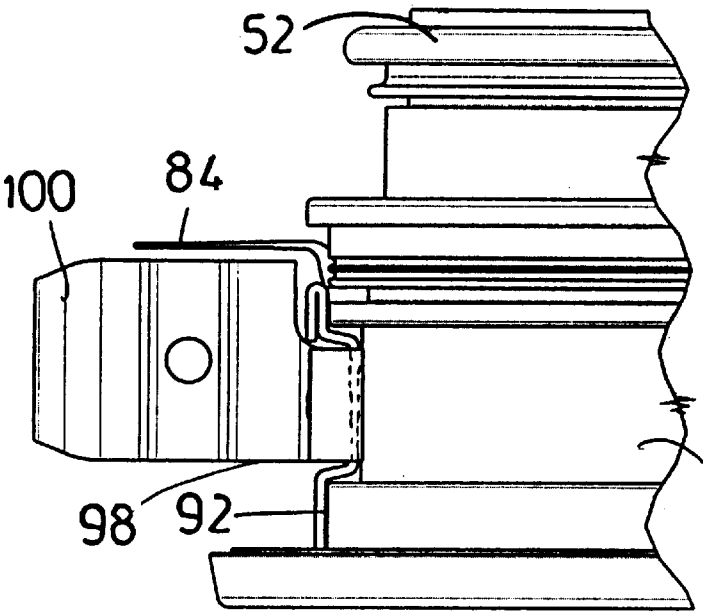
FIG. 7 shows details of the roof vent surround.

At the rear of the vent surround, so that it is spaced from the capping to allow the vent cover 54 to open, there is a spaced box 104 (see FIG. 8). The spacer box 104 is formed as a rectangular section extrusion with internal cross webs 106, 107 and has end caps 108 that are perforated to allow heat to dissipate from it. The spacer boxer 104 is secured in the channel 20 by means of screws 108, through the lower side 110 of the channel.

The spacer box 104 has oppositely orientated v-shaped ribs 112 on its front face 114, that snap fit into the recess 66 in the rear face of the surround. Above those ribs is a barbed projection 116 which fits the slot 68 in the rear face of the surround. Finally the top front edge of the spacer box has a co-extruded or bonded gasket 120 thereon to mask the joint between the spacer box and the surround.

The channel member 20 has undercladding 122 located thereon that has on a front top edge a co-extruded or borded gasket 124 to form a seal against the underside of the spacer box.

The free end of the bottom ledge 64 of the surround is shaped to receive a sealing strip 130 for between the ledge 64 and the underside of surrounding components of the roof.

The cover 54 of the vent has outer and inner parts 132, 134 respectively, that trap a glazing panel therebetween. Around the inside of the outer part 132 is a slot 136 and the inner part is of L-section with its upstand 138 barbed so as to be a press fit into the slot, the other limb of the L-section serving as on a ledge for glazing panel 14.

The outer cover part has an overhang 142 on the underside of which is a T-section slot 144 which slidingly retains an aluminium hinge part 146 that engages around the hinge part of the vent surround to allow the cover to be opened and closed. In the slot 78 in the top of the surround 52 is the gasket strip 80 for sealing between the cover and the surround.

By having the vent surround slide between glazing bars the vent cover can be made wider than was hitherto possible, which provides for improved ventilation and aesthetic appearance.

What is claimed is:

1. A conservatory roof comprising plural glazing bars, plural glazing panels, which are supported by and between some of the glazing bars, a roof vent, which comprises a surround supported by and between two of the glazing bars and further comprising a cover hinged to the surround, and a spacer box, which is mounted to a rear portion of the surround and which has perforations to allow heat to dissipate.

* * * * *